United States Patent [19]

Ovard

[11] 4,439,378

[45] Mar. 27, 1984

[54] COOLING TOWER SPLASH BAR METHOD AND APPARATUS

[76] Inventor: John C. Ovard, 3465 Ridgeview Dr., Santa Rosa, Calif. 95404

[21] Appl. No.: 496,931

[22] Filed: May 23, 1983

[51] Int. Cl.[3] ..... B01F 3/04

[52] U.S. Cl. ..... 261/111; 261/DIG. 11; 428/131

[58] Field of Search ..... 261/94, 111, 112, 113, 261/DIG. 11, DIG. 72; 264/241, 249, 294, 295, 339; 29/157 R, 157.3 D; 428/131, 138; 165/166, 169, 170

[56] References Cited

U.S. PATENT DOCUMENTS

| | | | |
|---|---|---|---|
| 2,047,444 | 7/1936 | Stedman | 261/94 |
| 2,497,389 | 2/1950 | Ahrens | 261/111 |
| 2,602,651 | 7/1952 | Cannon | 261/DIG. 72 |
| 2,809,813 | 10/1957 | Fletcher | 165/51 |
| 2,875,992 | 3/1959 | Pirsh et al. | 261/DIG. 72 |
| 2,986,379 | 6/1957 | Kramig, Jr. | 261/28 |
| 3,243,170 | 3/1966 | Ellis et al. | 261/94 |
| 3,262,682 | 7/1966 | Bredberg | 261/29 |
| 3,272,484 | 9/1966 | Brand et al. | 261/24 |
| 3,311,356 | 3/1967 | Eckert | 261/94 |
| 3,389,895 | 6/1968 | De Flon | 261/111 |
| 3,468,521 | 9/1969 | Furlong et al. | 261/111 |
| 3,647,191 | 3/1972 | Fordyce | 261/111 |
| 3,758,087 | 9/1973 | Hoon, Jr. | 261/DIG. 72 |
| 3,758,088 | 9/1973 | Fordyce | 261/111 |
| 3,823,924 | 7/1974 | Hoon, Jr. | 261/94 |
| 4,020,130 | 4/1977 | Ovard | 261/111 |
| 4,117,049 | 9/1978 | Carrico | 261/111 |
| 4,133,851 | 1/1979 | Ovard | 261/111 |
| 4,181,691 | 1/1980 | Cates et al. | 261/111 |
| 4,184,946 | 1/1980 | Kato | 261/94 X |

FOREIGN PATENT DOCUMENTS

| | | | |
|---|---|---|---|
| 32-373871 | 8/1957 | Japan | 261/DIG. 72 |

*Primary Examiner*—Richard L. Chiesa

*Attorney, Agent, or Firm*—Limbach, Limbach & Sutton

[57] ABSTRACT

A cooling tower splash bar method and apparatus are disclosed wherein splash bar elements are positioned in a matrix assembly with each element having elongate perforated upper and lower surfaces with the perforations in the surfaces staggered with respect to one another and with laterally outwardly projecting edge supports for the surfaces. Splash bar elements can include one or more interior longitudinally extending support members and notched projections along at least one longitudinal edge of the splash bar for holding the bar in the matrix assembly. A configuration for the splash bar element is disclosed with certain flat surfaces and certain upwardly projecting surfaces in the form of a single element which can be folded along its centerline to form the splash bar.

14 Claims, 9 Drawing Figures

COOLING TOWER SPLASH BAR METHOD AND APPARATUS

DESCRIPTION

The present invention relates to an improved method and apparatus for promoting the transfer of heat in a direct contact heat exchange apparatus designed for crossflow gas-liquid flow relationship.

BACKGROUND ART

There are a number of industrial processes wherein a liquid and a gas are brought into direct contact with each other for the purpose of effecting a transfer of heat from one medium to the other. The efficiency with which the heat transfer process occurs is dependent on the amount of liquid surface area that comes into direct contact with the gas. Most of the apparatus specifically designed for this type of process employs some physical means whose primary purpose is to promote the generation of liquid surface. This is accomplished by either promoting the generation of liquid droplets by means of a splash bar type fill assembly or by promoting the generation of thin liquid films on the surface of a cellular structure designed in such a way that the gas may flow through the passages of the cellular structure. The second type of media is commonly called a film type fill assembly. Examples of film type fill assemblies are shown in U.S. Pat. No. 2,809,813 patented on Oct. 15, 1957, U.S. Pat. No. 2,986,379 patented on May 30, 1961, U.S. Pat. No. 3,262,682 patented on July 26, 1966, U.S. Pat. No. 3,272,484 patented on Sept. 13, 1966, and U.S. Pat. No. 4,117,049 patented on Sept. 26, 1978.

U.S. Pat. Nos. 2,809,818 and 2,985,379 show film type packings composed of a plurality of thin sheets where adjacent sheets are secured by means of a suitable adhesive. The cellular structure is fabricated by arranging the sheets such that a flat sheet is adjacent to a corrugated sheet alternately throughout the structure thereby creating vertical passageways. Liquid is distributed or sprayed over the top of the cellular structure and flows downward through the passages adhering to the passage walls in the form of thin films. Concurrently the gas is forced upwardly through said passages in countercurrent flow relationship to liquid film flow. These designs are limited to counterflow arrangements and further their heat transfer efficiency is limited primarily because there is no means inherent in these designs to promote even distribution and uniform thickness and flow of the liquid film. Further there is nothing inherent in these designs to promote turbulence and mixing of the main body of gas flowing through the passages and gas stratification limits heat transfer efficiency.

U.S. Pat. No. 3,262,682 overcomes these limitations to some extent. All sheets are corrugated and adjacent sheets are oriented and connected such that the corrugations extend at an oblique angle relative to a horizontal plane with every second layer having its corrugations oriented obliquely in one direction with adjacent and subsequent second layers extending obliquely in the opposite direction. This cellular configuration creates passageways of constantly varying cross section and the passageways in both the horizontal and vertical directions have a serpentine-like shape. These features promote uniformity in the distribution and thickness of liquid films and causes the gas to mix thoroughly as it travels through the serpentine passages. Further, this cellular structure may be used in both counterflow and crossflow gas-liquid flow arrangements since gas may be directed to enter the passageways either from the bottom or side of the cellular structure respectively.

Further improvements in the flow and distribution of liquid in cellular film type packing designs are taught in U.S. Pat. Nos. 3,272,484 and 4,117,049. U.S. Pat. No. 3,272,484 shows cellular structures where the parallel passageways have either a hexagonal or triangular cross section with passages aligned in the generally horizontal direction of gas flow. In order to provide for the downward passage of liquid in direction transverse to the axis of the passages, walls of each passageway are apertured at spaced locations along the length thereof which provides liquid communication with the adjacent row of passages therebelow and succeeding rows of apertures are staggered so that liquid will be caused to distribute itself in the form of films on passageway walls during its downwardly directed flow through the cellular structure. U.S. Pat. No. 4,117,049 shows yet another means for redistributing liquid and gas within passageways created by means of a plurality of connected sheets whereby each adjacent, generally horizontal sheet pair is connected by means of accordian-like side walls thereby creating a cell with each sheet apertured on one side to permit communication of fluids from one cell to those immediately above and below. The apertures on an adjacent sheet are located on the opposite side of the cell. Said apertures act as staggered inlet and outlet ports for both liquid and gas flow in the cell created by two successive parallel sheets and the connecting, accordian-like side walls. By connecting a number of such cells vertically, a cellular column is formed with ports on opposite sides of each adjacent cell, and an independent zigzag fluid flow path is created in each cellular column between the top and bottom of the cellular structure.

Among the problems associated with film type packings is that the gas is required to flow through passages which are relatively small in cross section and further the gas is often required to follow a tortuous path while within the confines of the cellular structure. These factors result in relatively high resistance to flow of the gas stream which results in higher energy usage by the gas moving device of the apparatus. Consequently, the application of film type packings is limited to smaller systems or large systems where only a few feet of film type packing is required.

A further limitation is that the quantity of liquid per unit area must necessarily be limited since otherwise the flowing films of liquid on sheet surfaces become relatively thick thereby limiting the liquid-gas contact area, impeding heat transfer efficiency. These thick liquid films will also restrict the area of the gas flow passages thereby further increasing resistance to gas flow. Yet another limitation is that the cellular passages, being necessarily small in an effort to obtain maximum liquid surface area in a given volume, can easily plug up if any solid foreign matter or chemical substance with a tendency to precipitate is present in either the liquid or gas. Yet another limitation is that the sheets from which film pack structures are formed are necessarily thin for economic reasons and are easily crushed or damaged particularly along the edges. Shipping costs are also high since these relatively light weight structures consume substantial volume when shipped in assembled form and field assembly is usually prohibitive from a cost standpoint. Generally, film type packings will have high heat transfer capabilities per unit volume, but the limitations described above, coupled with high unit costs, limit their application in practice.

Splash bar type fill assemblies generally overcome the limitations of film type fill structures particularly noted above. These designs consist of a plurality of splash bars, supported in a frame or grid wherein said splash bars are placed in a horizontal plane in parallel, spaced-apart relationship in multiple rows wherein the splash bars in adjacent rows above and below are placed in staggered, offset relationship relative to each other. In direct contact heat exchange apparatus where the intended flow of the gas is generally in crossflow relationship with the flow of liquid, two general orientations of splash bar fill assemblies are known. The most common type consists of a matrix of splash bars as described above wherein the bars are oriented such that gas flow is generally perpendicular to the longitudinal axis of the individual bars. The vertical dimension of bars disposed in this orientation presents an obstruction to gas flow and of necessity splash bars designed primarily for this orientation should have a relatively low and aerodynamically efficient profile in the transverse direction to minimize the resistance to gas flow thereby minimizing the amount of energy required to induce gas flow through the apparatus. Prior art examples of splash bar designs oriented with the longitudinal axis of the bar perpendicular to gas flow have transverse shapes which generally demonstrate either a compromise in the strength of the splash bar, or project an aerodynamically inefficient profile in the gas flow direction are shown in U.S. Pat. No. 3,389,895 issued June 25, 1963, U.S. Pat. No. 3,468,521 issued Sept. 23, 1963 and U.S. Pat. No. 3,647,191 issued on Mar. 7, 1972.

U.S. Pat. No. 3,389,895 shows splash bars intended for the above-described orientation with open base triangular and rectangular transverse profiles and perforate surfaces, both of which present large and aerodynamically inefficient projected areas in the direction of gas flow. The same is true of the M-shaped open base profile shown in U.S. Pat. No. 3,647,191. In addition to the higher resistance to gas flow, these designs also have limitations in that gas deflected by the blunt projected area is directed away from at least part of the major splash surface of the profile and intimate mixing of gas and liquid is thereby impeded to some extent. Further, these profiles have only a small bearing surface area at points where bars rest on supporting grids which results in excessive wear at these points with a substantial shortening of the useful life of the splash bar since the profile eventually wears through at these contact points.

U.S. Pat. No. 3,468,521 shows a similarly oriented splash bar consisting of a perforate strip having an elongated, convex leading edge where the upper surface slopes downwardly, terminating at the convex leading edge. While this profile presents a generally more favorable profile in the direction of gas flow, it still has the limited bearing surface at grid support points noted above. Further, the sloped upper surface will cause liquid impinging on said surface to collect and flow forward in streams unless the perforate surface has relatively large holes to allow liquid to pass therethrough. In practice larger holes are used to avoid this. However, the larger holes result in less effective mechanically induced droplet fragmentation of liquid forced through the perforate surfaces thereby diminishing the extent of droplet generation and dispersion that otherwise might be achieved and diminishing the overall heat transfer efficiency.

Other splash bar configurations specifically designed for an orientation such that the gas flow is parallel to the longitudinal axis overcomes some of the limitations noted above and generally offer less resistance to gas flow. Typical examples are found in U.S. Pat. No. 2,497,389 issued Feb. 14, 1950, U.S. Pat. No. 3,758,088 issued Sept. 11, 1977, U.S. Pat. No. 4,020,130 issued Apr. 26, 1977, U.S. Pat. No. 4,133,851 issued Jan. 9, 1979 and U.S. Pat. No. 4,181,691 issued Jan. 1, 1980.

U.S. Pat. Nos. 2,497,389 and 3,758,088 show planar and non-planar sine wave fill members respectively, oriented with the longitudinal axis of the fill member parallel to the direction of gas flow. These profiles have no perforate openings and thus lack the ability to fragment liquid by shearing as liquid passes through the perforate surfaces embodied in other designs.

Designs with perforate surface sections such as those shown in U.S. Pat. Nos. 4,020,130, 4,133,851 and 4,181,591 overcome this limitation, but still do not provide the advantages of the present invention. In particular, the profiles shown in U.S. Pat. Nos. 4,020,130 and 4,181,691 incorporate horizontal perforate surfaces which provide the main means for splash and mechanically induced liquid fragmentation and dispersion.

The designs taught in U.S. Pat. No. 4,020,130 consist of two horizontal perforate strips connected by means of one vertical perforate strip where the free edges of said horizontal perforate strips terminate in a small lip or projection to provide additional lateral stability and strength to the profile. In order to obtain adequate structural strength and stability of the profile it is necessary to limit the extent of the transverse dimension of the horizonal perforate surfaces which provide the main means of liquid splash and fragmentation. This reduces the overall liquid dispersion effectiveness that might otherwise be obtained since a limited horizontal perforate surface is present to disperse and fragment liquid on a given splash bar. Further, the vertical strip connecting said horizontal surfaces must extend vertically a significant distance, again to achieve reasonable structural strength and the profiles taught must be supported within the confines of a grid support system containing means for restricting movement of the top, bottom and lateral extents of the profile. These dimensional limitations, which exist primarily for practical structural reasons, limit the application of these profiles to crossflow liquid-gas flow relationships where the gas flows parallel to the longitudinal axis of the profile. If these profiles are oriented with gas flow perpendicular to the longitudinal axis of the profile the vertical connecting element presents an extensive, and blunt projection in the direction of gas flow thereby creating a higher resistance to gas flow than desired. The splash bar profile of U.S. Pat. No. 4,181,691 overcomes the problem of having to limit the transverse extent of the horizontal perforate surface by incorporating a vertical strip at each of the transverse edges of the horizontal perforate strip. Said strips must again project vertically upward a significant distance to obtain the desired structural strength of the profile. Thus this profile is again only suitable for crossflow orientation with gas flow parallel to the longitudinal axis of the splash bar for reasons explained above. The splash bar profiles taught in both of these patents have a further and very significant limitation in that the vertical strips and edge lips extend upward from at least one of the major horizontal liquid splash and dispersion surfaces and an open U-shaped channel is presented to falling liquid which can cause a portion of the liquid impacting the horizontal surface to be trapped in the trough thus formed. While this trapped liquid will eventually drain through the perforate surface, the formation of thick liquid films on the horizontal surface will diminish the effectiveness of splash induced liquid fragmentation on said surfaces. In addition, some of this liquid will migrate down the longitudinal axis of the splash bar in the direction of gas flow. Further, liquid passing through the holes and/or overflowing the vertical side strips will continue its fall in the form of heavy streams as opposed to droplets. These factors have a negative impact on the uniformity of water distribution throughout the splash bar matrix area and reduce the liquid contact surface area that might otherwise be achieved.

The splash bar profiles taught in U.S. Pat. No. 4,133,851 overcome the trapped liquid and flow uniformity problems noted above by incorporating only one vertical perforate or imperforate strip in the profile design and by positioning said vertical strip parallel to the longitudinal axis of the bar and positioned either at center or at a single transverse edge of the horizontal, perforate surface of the bar. Further the edges of both the vertical and horizontal strips include a bevel or skirt whose purpose is to direct any accumulating water toward the horizontal splash surface of said bar or horizontal surface of other splash bars located below in the splash bar assembly matrix which are positioned in lateral offset relationship. Vertical strips and the beveled skirts provide some functional advantages as noted above but also must be relied upon to provide structural strength and rigidity to the splash bar. The structural limitations of U.S. Pat. No. 4,020,130 as relates to practical limits on the lateral extent of the horizontal perforate surfaces and subsequent limit of liquid dispersion capability still exist with this teaching as does the necessity to limit its application to an orientation wherein gas flow is parallel to the longitudinal axis of the splash bar for reasons described above. Thus while all three of these patents offer some improvement over prior art, they still fail to provide a splash bar configuration that can provide the ultimate combination of maximum liquid splash and dispersion characteristics, and hence maximum heat transfer, uniform liquid dispersion and distribution throughout the entire splash bar fill matrix area, minimum resistance to gas flow independent of orientation of the splash bar relative to gas flow direction and exceptional strength without limiting the dimensions of the splash bar in a way that will either detract from the performance characteristics of the splash bar or ultimately result in the use of more material to achieve the same results. The teachings of the present invention overcome these limitations.

While the differences in the various splash bar designs found in the prior art may appear subtle, those skilled in the art will recognize that they are never the less critical in terms of the ability of a given profile to generate maximum liquid contact surface area and the overall heat transfer capability of the splash bar matrix assembly as well as their effect on the overall energy requirements of the gas moving device of the apparatus. Further, the strength, durability and cost are major considerations that cannot be overlooked. Clearly, much is yet to be done to obtain the ultimate functional relationship between gas and liquid in a splash bar design and assembly matrix while at the same time minimizing resistance to gas flow, providing adequate strength and durability and obtaining liquid flow uniformity and increasing liquid retention time throughout the splash bar assembly matrix.

DISCLOSURE OF INVENTION

The present invention relates to an improved method and apparatus for promoting the transfer of heat in a direct contact heat exchange apparatus designed for crossflow gas-liquid flow relationship by means of a splash bar design and assembly matrix design that substantially increases the liquid surface contact area of a falling liquid by both splash and mechanically induced liquid fragmentation.

An objective is to provide a design that promotes uniformity of both liquid and gas flow and distribution throughout the fill matrix assembly area. Another objective is to increase liquid-gas contact time. Another objective is to provide a splash bar with an aerodynamically efficient profile such that said splash bar will provide intimate mixing of gas and liquid and minimum resistance to gas flow when it is oriented with the longitudinal axis either parallel or perpendicular to the gas flow direction. Yet another object of this invention is to provide a substantial increase in the durability and structural strength of the splash bar in all directions when hanging in a grid support system. A final object of the invention is to provide a means for connecting said splash bar to the vertical elements of the supporting grids while minimizing interference with liquid distribution throughout the fill assembly matrix.

Broadly stated, the present invention, to be described in greater detail below, is directed to a splash bar which incorporates the objects and advantages set forth above in a matrix assembly comprised of a plurality of said longitudinally extended splash bars positioned in horizontal, side-by-side spaced-apart relation in a plurality of vertical, spaced-apart rows where splash bars in adjacent vertical rows are spaced in horizontal offset relationship to those immediately above and below. Each splash bar having a pair of horizontal perforate surfaces connected at transverse edges by means of convex outwardly extending perforate or imperforate strips.

In the preferred embodiment of the present invention said horizontal perforate strips are also connected by means of one or more interior vertical strips which greatly increase the strength of the profile without influencing performance.

The object of providing a means for connecting the splash bar to the vertical elements of the support grid is accomplished by means of a horizontally projecting strip attached to the outermost edge of at least one of the outwardly extending convex strips connecting the horizontal pair of perforate strip elements, said longitudinally extended edge strips containing periodic perforations to engage vertical elements of the supporting grids in the fill assembly matrix.

Expressed in another way, the invention is directed to an apparatus for, and method to cause vertically falling liquid to encounter first a horizontal perforate surface which causes a portion of said liquid to be fragmented by splashing in the imperforate sections of said surface and the balance of said liquid to be fragmented by shear forces as it passes through the perforations. Liquid passing through the top perforate surface then encounters the second perforate surface where further liquid fragmentation is accomplished by the same means. In addition, the velocity of the falling liquid is further reduced by its encounter with the second horizontal surface. The splash bar of the present invention creates substantially greater liquid fragmentation and hence greater liquid contact surface area and increases liquid fall time. Further, its efficient aerodynamic shape in the horizontal plane of gas flow improves the intimate mixing of gas and liquid beyond what is possible with other known splash bars and does so with minimum gas flow energy losses and without compromising the strength of the splash bar.

In accordance with another embodiment of the present invention, the novel splash bar is constructed from a single integral foldable member comprised principally of a pair of elongate perforated flat surface members with their elongate edges parallel to one another and joined together by a pair of upwardly inclined elongate narrow surface members which are in turn connected together by a flexible joint at their edges remote from the elongate edges of the flat members. Similarly upwardly and outwardly inclined elongate narrow surfaces are provided at the remote elongate edges of the flat surface members so that the single member can be folded in half along the joint to form a hollow member with perforation patterns in offset relation to one another.

The folded member can be secured together in appropriate manner, and in accordance with another aspect of the present invention, the remote edges of the outwardly upwardly inclined surface members are provided with narrow upwardly inwardly inclined surface members which serve to interlock the foldable member in folded position along a transverse edge of the folded member. In accordance with another aspect of the present invention the single foldable member is provided appropriately spaced upwardly projecting cooperating elements on the two flat perforated surface members and which interlock when the member is folded for holding the folded member in folded position and rigidifying the flat perforated surfaces of the folded member.

Other features and objects of the invention will become apparent to those skilled in the art as the invention is further disclosed. The invention is further described in terms of its application to mechanical draft crossflow cooling towers, but those skilled in the art will recognize its applicability to natural draft or hyperbolic cooling towers and other direct contact heat and mass transfer apparatus where gas and liquid flow in cross current relationship.

BRIEF DESCRIPTION OF DRAWIGS

Figure 5:
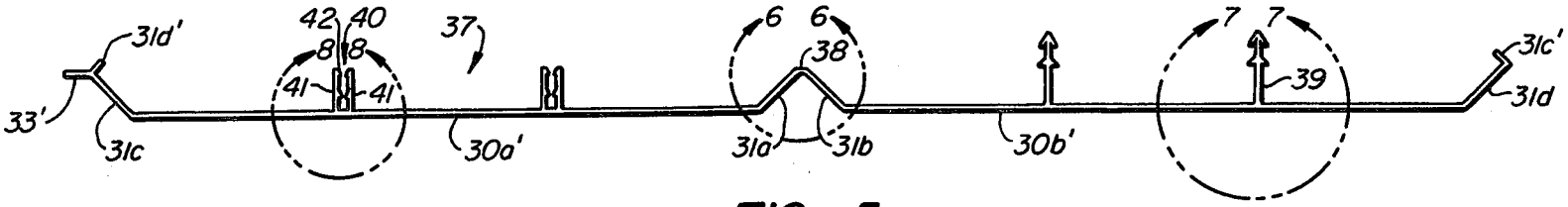
FIG. 5 is an elevational end view of the structure shown in FIG. 4.
Figure 6:
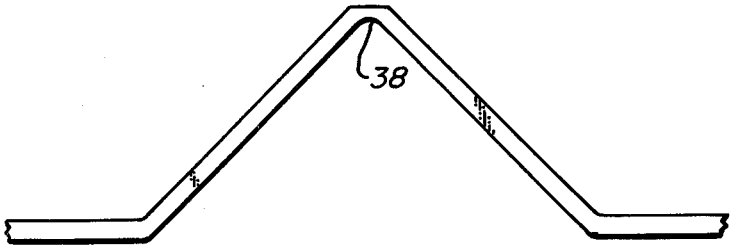
Figure 7:
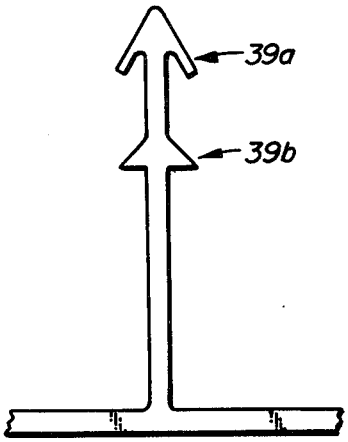
Figure 8:
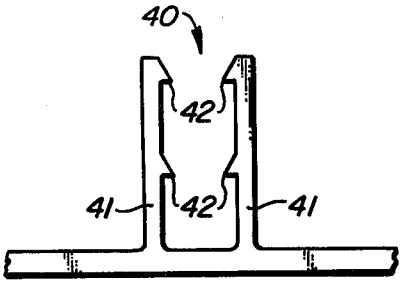

FIGS. 6, 7 and 8 are enlarged sectional views of the portions of the structure shown in FIG. 5 delineated by lines 6—6, 7—7 and 8—8, respectively.

Figure 4:
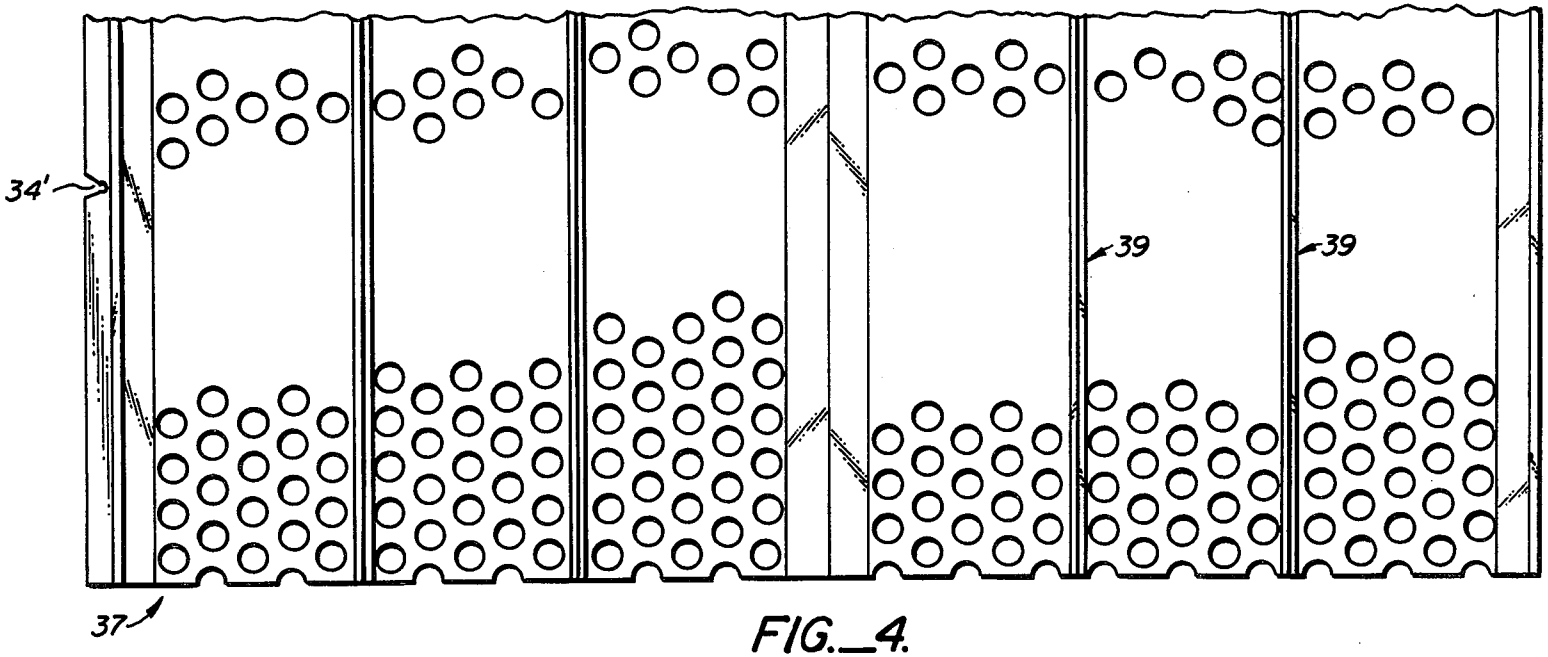
FIG. 4 is a foreshortened plan view showing the construction details of foldable single member for forming a splash bar of the preferred embodiment of the present invention.
Figure 9:
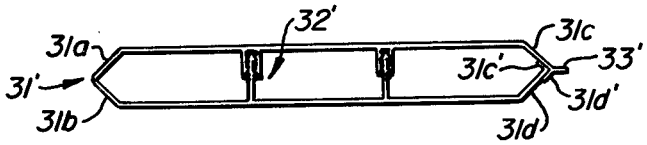

FIG. 9 is an elevational end view of the structure shown in FIG. 4 folded to form a splash bar in accordance with the present invention.

BEST MODE FOR CARRYING OUT THE INVENTION

Figure 1:
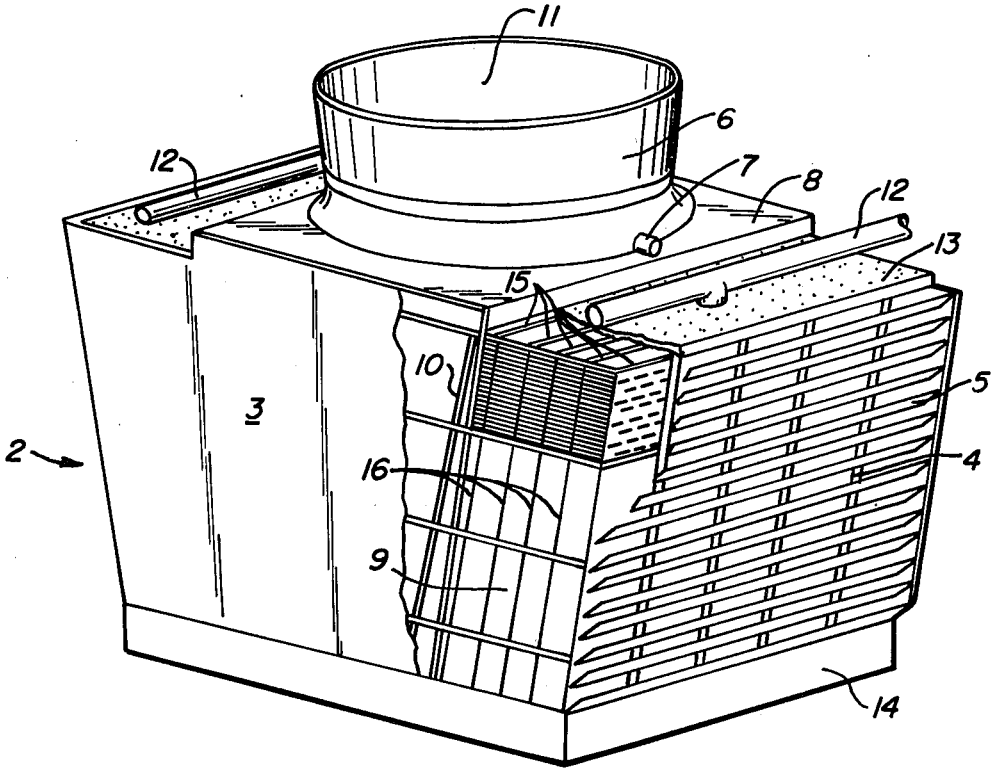
FIG. 1 is an isometric view of a typical mechanical draft, crossflow water cooling tower cell.

FIG. 1 illustrates a typical induced draft crossflow cooling tower 2, having two sides 3 closed and two sides 4 open with the open sides acting as the atmospheric air intakes for the cooling tower. The open sides are fitted with air intake louvers 5 whose primary purpose is to diminish the effects of high winds while keeping water contained within the tower during such occurrences and during times when the fan is off. The cooling tower has the usual induced draft axial flow fan (not shown), fan shroud 6, and fan drive motor 7 located on the enclosed top deck 8 which draws air through the intake louvers 5. Air the travels horizontally through the fill assembly area 9, through the drift elimination section 10, and finally is drawn vertically upwardy through the fan and is thereafter discharged at the top of the fan stack shroud 11.

The tower is equipped with the usual hot water distribution piping system 12 which distributes hot water to the hot water basin 13. Nozzles located in the floor of the hot water basin 13 spray and distribute water over the entire top of the fill assembly area 9 after which the water falls by gravity through the fill assembly area 9 being finally collected in the cold water basin 14 at the bottom of the tower.

Figure 2:
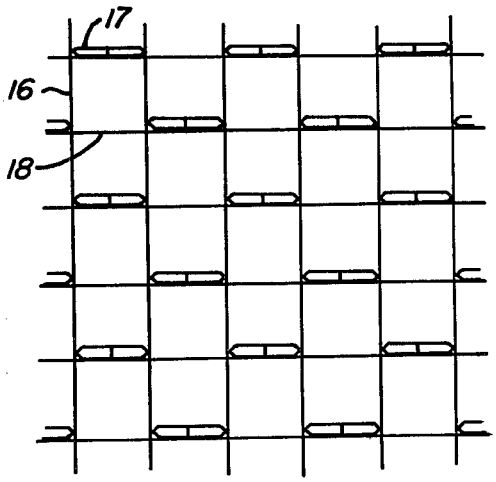
FIG. 2 is an end view of a portion of the fill assembly area matrix showing the splash bar support grids and splash bars therein.
Figure 3:
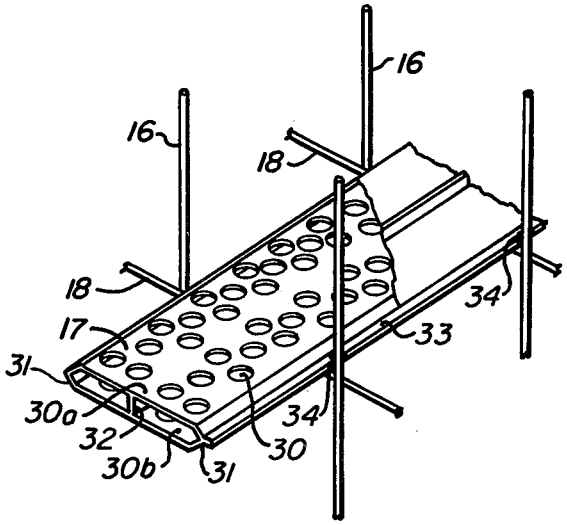
FIG. 3 is an isometric fragmentary view of the splash bar support grid with a splash bar lying therein. A portion of the top surface is cut away to reveal the bottom perforate surface.

Referring to FIGS. 2 and 3 in conjunction with FIG. 1, it is seen that the fill assembly area 9 is comprised of grid support beams 15 attached to the conventional cooling tower structure at the top and at intermediate heights as may be appropriate. The splash bar support grids 16 are suspended from support beams 15 and they in turn provide support for individual splash bar elements 17 which are supported periodically along their length by the horizontal elements 18 of the support grids 16. The splash bar elements 17 are positioned in the support grids 16 in horizontal, spaced-apart relationship in each row as shown in FIG. 2 with splash bars in adjacent rows located in offset relationship to splash bars in rows immediately above and below. FIG. 1 illustrates a fill assembly orientation where the splash bars are oriented with their longitudinal axis parallel to the direction of air flow. Clearly, the entire fill assembly area can be rotated 90 degrees thereby orienting the individual splash bar elements 17 such that air flow is perpendicular to the longitudinal axis of the splash bar elements simply by connecting the fill grid support beams 15 to the tower structure in the transverse direction rather than the longitudinal direction as shown in FIG. 1.

A preferred embodiment of the splash bar elements 17 of the present invention is illustrated in FIG. 3. A pair of spaced-apart, elongated, generally flat horizontal perforate strips or members 30*a* and 30*b* are connected at their transverse extremes by a pair of elongated, outwardly projecting convex strips or members 31. An interior, intermediate, elongated imperforate vertical web element 32 connecting the horizontal, perforate strips is also shown whose primary purpose is to add strength to the splash bar without influencing performance. One or more such vertical strips may be incorporated in the profile depending on the overall splash bar width and degree of strength desired. An elongated, horizontal side strip 33 is attached to one of the convex strips 31 at mid-height and periodic notches 34 are provided therein to engage the vertical elements of the support grid 16 thereby molding the splash bar element 17 in place.

The pattern of perforations 30 in the upper perforate member 30*a* is staggered with respect to the pattern of perforations 30 in the lower perforate member 30*b*.

When water falling by gravity through the fill assembly area encounters the top horizontal surface 31*a*, a portion of the water is fragmented by splashing in the imperforate areas between holes. The balance of the water passes through the perforations where it is further fragmented by shear as droplets attempt to pass through the holes. The fall velocity of the liquid is slowed as it impacts this surface.

Liquid passing through the top surface 30*a* immediately encounters the lower horizontal perforate surface 30*b*. The perforations in this surface are placed in offset relationship to those in the top surface such that water reaching the second surface is again fragmented by splash and liquid shear. Holes in the top perforate surface may differ in both size and shape from the holes in the bottom perforate surface as may be appropriate for liquids with different viscosities, flow characteristics or different liquid flow densities per unit plan area. Air flowing either parallel or transverse to the longitudinal axis of the splash bar in a generally horizontal plane encounters the aerodynamically efficient profile of the splash bar which results in minimum disturbance and resistance to air flow. The air intimately mixes with the fragmented liquid as it travels either transverse or parallel to the axis of the splash bar. The combined objectives of greater liquid contact surface area, intimate mixing of air and water, uniformity in both gas and liquid flow throughout the fill assembly area and added splash bar strength and durability are thus achieved with the splash bar design of the present invention.

The manufacture of a splash bar according to the present invention may be accomplished in a variety of ways depending on the material and manufacturing processes used. In any event, it is difficult and inefficient from a manufacturing standpoint to perforate the horizontal paired strips 30*a* and 30*b* with the splash bar profile in final form as shown in FIGS. 2 and 3. One of the best manufacturing methods for obtaining multiple perforations in a horizontal flat strip is to use a multiple hole punch die and press where a substantial section of the strip is perforated by one stroke of the press. This process requires that the bottom surface of the material to be punched be fully supported by a substantial die base plate with holes in said plate matching the desired hole shape and multiple hole pattern as that required in the finished part. The die top plate is fitted with pins which match these holes in both shape and position there being a small but relative difference in hole to pin size and shape to allow proper operation. The material to be perforated is placed between these two plates and applied pressure causes the pins in the top plate to shear through the material. One way that such a perforating arrangement can be utilized to produce the profile of the present invention is by making the upper and lower portions of the profile separately, punching the perforations of the upper and lower horizontal surfaces separately and connecting said portions by some means.

The construction as shown in FIGS. 4–9 makes it possible to manufacture the part completely in one continuous, in-line and automated operation utilizing a standard punch press and die set to obtain the perforate surfaces of the profile using a single, integral foldable member.

As shown in FIGS. 4–8, the single foldable member 37, such as of molded plastic, comprises a pair of elongate perforated flat surface members 30*a*′ and 30*b*′ which are substantially coplaner. These surface members are connected along their adjacent elongate edges by upwardly inclined narrow surface members 31*a* and 31*b* which are flexibly joined together by an elongate joint 38 such as a reduced thickness extending substantially parallel to the adjacent elongate edges of the flat surface members 30*a*′ and 30*b*′. At the remote elongate edges of the surface members 30*a*′ and 30*b*′ upwardly outwardly inclined narrow elongate surface members 31*c* and 31*d* are formed respectively. Short upwardly inwardly inclined surface members 31*d*′ and 31*c*′ are provided at the remote elongate edges of the surface members 31*c* and 31*d* respectively for securing the foldable members in folded condition as described in greater detail below. A narrow elongate strip surface member 33′, parallel to the flat surface members 30*a*′ and 30*b*′ is joined to the remote elongate edge of the inclined surface member 31*c* and provided along its length with notches 34′ for engaging the support members of the matrix support for the splash bar.

Intermediate the inclined surface members 31*b* and 31*d* one or more upwardly projecting elongate members or ridges 39 are positioned and provided in vertical transverse cross section with barbs 39*a* and 39*b* at and adjacent its upward free end. Similarly located intermediate the inclined surface members 31*c* and 31*a* and projecting upwardly from the surface member 30*a*′ are a pair of closely spaced elements 41 forming a channel member 40 with inwardly directed projections 42 to cooperate with the barbs 39*a* and 39*b* of the ridge in the manner described below.

The pattern of perforations in the flat surface member 30*a*′ is staggered relative to the pattern of perforations in the flat surface 30*b*′.

With the part 37 manufactured as shown in FIGS. 4–8, the final profile of FIG. 9 is obtained by folding the part, rotated about the joint 38 at the transverse centerline of the part 38 together so that the elongated barbs 39*a* and 39*b* of projection 39 engage and lock between the elongated vertical elements 41 forming channel 40. The lip at the right hand transverse edge formed at the joint between members 31*d* and 31*c*′ interlocks with the interior surface of an identical lip on the left hand transverse edge formed at the joint between members 31*c* and 31*d* so that surfaces of members 31*c* and 31*c*′ are parallel and in contact as are surfaces of members 31*d* and 31*a*. Said interlocked edges may be further secured by welding or other means if deemed appropriate.

What is claimed is:

1. For use with a crossflow water cooling tower having a hot water distributor for distributing water onto a splash bar assembly structure, a cold water basin and means for inducing crossflow movement of air therebetween, a combination therewith of splash bar assembly structure comprising, a series of elongated generally horizontal splash bar elements;

means supporting said splash bar elements in the space between the hot water distributor and said cold water basin in horizontal and vertical spaced relationship;

said splash bar elements having their longitudinal axes positioned substantially horizontal;

each of said splash bar elements having an elongate substantially flat, perforated upper surface member;

an elongate substantially flat, perforated lower surface member;

an elongate strip member at each side of said splash bar element and connected to the adjacent transverse extreme edges of said upper and lower surface members holding said surface members in parallel spaced-apart relation, the perforations of said upper surface member staggered with respect to the perforations of said lower surface member.

2. The splash bar assembly of claim 1 wherein each of said strip members projects laterally outwardly of the interior of said splash bar element.

3. The splash bar assembly of claim 1 wherein each of said splash bar elements includes an elongate horizontal side strip member on at least one of said strip members and projecting away from the splash bar element and having periodic notches provided therein for engaging said supporting means thereby holding said splash bar element in place.

4. The splash bar assembly of claim 1 wherein each of said splash bar elements includes at least one interior vertical support member extending longitudinally of said splash bar element between said lower surface member and said upper surface member and holding said surface members in parallel spaced apart relation.

5. In a matrix assembly of a plurality of longitudinally extending splash bar elements positioned in horizontal, side-by-side spaced apart relation in a plurality of vertical, spaced-apart rows where splash bar elements in adjacent vertical rows are spaced in horizontal offset relationship to those splash bar elements immediately above and below, an improved splash bar element comprising means forming an elongate, perforated upper surface;

means forming an elongate, perforated lower surface; and laterally outwardly projecting edge support means connecting the adjacent elongate edges of said upper and lower surfaces and holding said surfaces in substantially parallel spaced-apart relationship;

the perforations of said upper surface staggered with respect to the perforations of said lower surface.

6. The splash bar element of claim 5 including at least one interior longitudinally extending support member intermediate said edge support means connected to said upper and lower surfaces for supporting said surfaces in spaced apart relationship.

7. The splash bar element of claim 5 including means extending horizontally outwardly from at least one of said edge support means and having periodic notches therein for engaging the support members holding the matrix assembly.

8. A foldable member for forming a cooling tower splash bar comprising a first elongate perforated flat surface member;

a second elongate perforated flat surface member substantially coplanar with said first surface member and positioned adjacent thereto;

upwardly inclined third and fourth elongate surface members connected respectively to the adjacent elongate edges of said first and second surface members;

said third and fourth surface members flexibly joined together by an elongate joint extending substantially parallel to said adjacent elongate edges; and upwardly outwardly inclined fifth and sixth elongate surface members connected respectively to the remote elongate edges of said first and second surface members;

whereby first, third and fifth surface members can be folded over along said joint and on top of said second, fourth and sixth surface members to form a hollow member with the remote elongate edges of said fifth and sixth surface members then adjacent one another.

9. The foldable member of claim 8 wherein the perforations of said first surface member are staggered with respect to the perforations of said second surface member so that fluid passing through the perforations of said first and second surface members will strike at least a portion of said first and second surface member when the surface member are folded together.

10. The foldable member of claim 8 including means for securing the remote elongate edges of said fifth and sixth surface members together.

11. The foldable member of claim 10 wherein said securing means includes upwardly inwardly inclined seventh and eighth elongate surface members connected respectively to the remote elongate edges of said fifth and sixth surface members whereby said seventh and eighth surface members will be positioned respectively adjacent and parallel to said sixth and fifth surface members in said folded over position.

12. The foldable member of claim 8 including elongate upwardly projecting members on said first and second surfaces for connection together for locking the foldable member in folded position and holding said first and second surface members in substantially parallel spaced-apart relation.

13. The foldable member of claims 8, 9, 10 or 12 including an elongate strip surface member parallel to said first and second flat surfaces and joined to the remote elongated edge of the fifth surface, the free elongate edge of said strip surface member having periodic notches for engaging the support members of a matrix support for the splash bar.

14. A method of cooling a liquid in a cross flow cooling tower includes a matrix of longitudinally extending splash bars each having upper and lower elongate perforated surfaces held in parallel spaced apart relation to one another by laterally outwardly projecting edge supports connecting the adjacent elongate edges of said surfaces, said method comprising the steps of:

flowing air horizontally through said matrix;

splashing warm liquid through said matrix in cross-flow within said air flow;

directing a first portion of said liquid downwardly to impinge upon said upper surface of said splash bars to fragment and laterally disperse said first portion;

directing a second portion of said liquid and a first subportion of said first portion of said liquid laterally dispersed on said upper surface downwardly to pass through the perforations of said upper surface to impinge upon said lower surface of said second portion and said first subportion;

deflecting said first subportion and the second subportion of said first portion, and said second portion laterally of air flow through said matrix; and repeating said flowing, splashing, directing and deflecting steps through said matrix to fragment said liquid into uniformly dispersed droplets for creating maximum heat exchange surface between said liquid and air.

* * * * *